US010385532B2

(12) United States Patent
Reelick

(10) Patent No.: US 10,385,532 B2
(45) Date of Patent: Aug. 20, 2019

(54) TIMBER POLE FOUNDATION STRUCTURE

(71) Applicant: FELLROCK DEVELOPMENTS LIMITED, Auckland (NZ)

(72) Inventor: John Matthias Reelick, Tuakau (NZ)

(73) Assignee: Fellrock Developments Limited, Auckland (NZ)

( * ) Notice: Subject to any disclaimer, the term of this patent is extended or adjusted under 35 U.S.C. 154(b) by 0 days.

(21) Appl. No.: 15/755,539

(22) PCT Filed: Aug. 26, 2016

(86) PCT No.: PCT/IB2016/055093

§ 371 (c)(1),
(2) Date: Feb. 26, 2018

(87) PCT Pub. No.: WO2017/037588

PCT Pub. Date: Mar. 9, 2017

(65) Prior Publication Data

US 2018/0251949 A1 Sep. 6, 2018

(30) Foreign Application Priority Data

Aug. 28, 2015 (NZ) ..... 711597

(51) Int. Cl.
*E02D 27/02* (2006.01)
*E02D 27/08* (2006.01)
*E02D 27/34* (2006.01)

(52) U.S. Cl.
CPC ..... *E02D 27/02* (2013.01); *E02D 27/08* (2013.01); *E02D 27/34* (2013.01)

(58) Field of Classification Search
CPC ..... E02D 27/02; E02D 27/08; E02D 27/34; E02D 27/42; Y10T 403/7194;
(Continued)

(56) References Cited

U.S. PATENT DOCUMENTS 3,415,554 A * 12/1968 Papayoti ..... E04G 7/24 403/187
3,884,002 A * 5/1975 Logie ..... E04B 1/6162 312/263
(Continued)

FOREIGN PATENT DOCUMENTS

CN 101519870 9/2009
DE 3132477 4/1983
(Continued)

OTHER PUBLICATIONS

TTT Raft Foundations [retrieved from internet on Nov. 9, 2016] <URL:http://web.archive.org/web/20160123043702/http://www/tttproducts.co.nz/assets/case-study-ttt-raft-foundations-crf01---nov15.pdf> published on Jan. 23, 2016 as per Wayback Machine.

*Primary Examiner* — Brian E Glessner
*Assistant Examiner* — Adam G Barlow
(74) *Attorney, Agent, or Firm* — Dentons US LLP

(57) ABSTRACT

A foundation for supporting a structure above. The foundation comprising a first layer of poles parallel and spaced apart from each other, and a second layer of timber poles parallel and spaced apart from each other, at an angle to the first layer. The first layer on top of, and fastened to, the second layer. Compared to prior art foundations, the foundation is versatile, light weight, easy and quick to install and can be disassembled and re-used.

20 Claims, 14 Drawing Sheets

(58) Field of Classification Search
CPC ..... Y10T 403/75; F16B 7/044; F16B 7/0446; E04H 12/2261; E04B 1/0007; E04B 2001/2684
USPC ... 52/169.8, 169.9, 292, 294, 295, 664, 665, 52/649.1; 403/400, 408.1
See application file for complete search history.

(56) References Cited

U.S. PATENT DOCUMENTS 4,405,253 A * 9/1983 Stockum ..... F16B 12/2027 108/158
4,738,061 A * 4/1988 Herndon ..... E02D 27/02 52/126.6
4,788,809 A * 12/1988 Koukourou ..... E02D 27/01 52/321
5,083,404 A * 1/1992 Schulte ..... E04B 1/34336 52/167.1
5,421,136 A * 6/1995 Van De Peer ..... E02D 27/08 52/294
5,722,211 A * 3/1998 Goldschmidt ..... E04C 2/38 108/57.17
5,741,083 A * 4/1998 Schvartz ..... E04B 1/2604 403/297
5,881,515 A * 3/1999 George ..... A63H 33/044 403/294
6,032,431 A * 3/2000 Sugiyama ..... E04B 1/2604 52/656.9
6,120,207 A 9/2000 Goto
8,074,413 B2 12/2011 Stein
8,474,205 B1 7/2013 Watkins
2012/0137627 A1* 6/2012 Vemuri ..... E04C 3/08 52/665
2013/0125497 A1* 5/2013 Kumakawa ..... E04B 1/48 52/655.1
2015/0197957 A1* 7/2015 Anderson ..... E04H 12/2246 52/126.5
2017/0328023 A1* 11/2017 Smith ..... E02D 27/42

FOREIGN PATENT DOCUMENTS

DE 8710109 9/1987
JP H0790924 4/1995
KR 10-0929366 12/2009

* cited by examiner

TIMBER POLE FOUNDATION STRUCTURE

This application is a National Stage Application of International Application No. PCT/IB2016/055093 filed on Aug. 26, 2016, which claims priority to and the benefit of New Zealand Patent Application No. 711597, filed with the Intellectual Property Office of New Zealand on Aug. 28, 2015, both of which are incorporated herein in their entirety by reference for all purposes as if fully set forth herein.

FIELD OF THE INVENTION

The present invention relates to a timber pole foundation structure.

BACKGROUND

A foundation is an element of construction that connects a building to the ground. It can transfer loads from the building to the ground. Foundations are generally considered either shallow or deep or a combination of both depending on the ground conditions below the building.

Shallow foundations are usually embedded about a meter or so into soil.

A common type of shallow foundation is the slab or raft foundation where the weight of the building is transferred to the soil through a concrete slab placed at or near the surface. Slab foundations can be reinforced mat slabs, which range from 25 cm to several meters thick, depending on the size of the building, or post-tensioned slabs, which are typically at least 20 cm for houses, and thicker for heavier structures.

For a timber floor house foundation the usual method in New Zealand is to dig out a pit approximately 800 mm-1000 mm of earth and remove off site. The costs for disposing this soil/earth off-site can be high particularly if environmental charges are levied. This may occur in the soil has been contaminated or if cross contamination between pit soil and the environment at where it is disposed may occur. Or if soil treatment is necessary prior to disposal.

A minimum ground pressure condition is needed to ensure the foundation and structure are sufficiently supported by the ground. For example, the pit typically needs to provide 200 kPa ground conditions.

In known shallow foundation constructions, a gravel raft may be created in the pit and may be composed of compacted gravel with layers of geocloth between. Concrete may then be poured over to create a concrete slab on top of the gravel raft. This may be approximately 150-400 mm thick as an example.

Square timber foundation piles (jack studs) may be installed in the concrete as the concrete slab is being constructed. Bearers, joists, framework and/or formwork may be supported by the jack studs.

The process of creating this foundation is time consuming because of the number of steps and the often different trades or suppliers of materials being involved.

The weight of this sort of foundation for a 200 sqm house may be in the order of 240 tonne.

Typical concrete raft or slab foundations are brittle due the nature of the concrete. They are strong but not very resilient. Concrete slab foundations may also be prone to shifting and elevation by liquefaction in earthquake prone areas. This can damage the foundation.

Once a concrete slab foundation has been laid it may be very difficult to move or modify. Removal involved destruction of the foundation.

It is an object of the present invention to provide a timber pole foundation that overcomes or at least ameliorates some of the abovementioned disadvantages or which at least provides the public with a useful choice.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purpose of this specification, where method steps are described in sequence, the sequence does not necessarily mean that the steps are to be chronologically ordered in that sequence, unless there is no other logical manner of interpreting the sequence.

BRIEF DESCRIPTION OF THE INVENTION

Accordingly, in a further aspect the present invention relates to a foundation for supporting a structure above, the foundation comprising a. a first layer of at least two timber poles, each pole of the first layer parallel and spaced apart from each other, b. a second layer of at least two timber poles, each pole of the second layer parallel and spaced apart from each other, each laying on timber poles of the first layer at an angle to span across at least two poles of the first layer and each fastened to each said two poles of said first layer at the intersection of said poles.

Preferably wherein the at least two poles of the second layer and the at least two poles of the first layer are, at each pole to pole intersection, fastened to each other by a penetrated fastener.

Preferably at each intersection, the penetrated fastener extends vertically.

Preferably the penetrated fastener extends upwardly from a first layer pole into the juxtaposed second layer pole.

Preferably, the penetrated fastener is not exposed at where the poles at the intersection touch.

Preferably, at each intersection the first layer pole includes a hole that is selected from one of a blind hole and a through hole and the juxtaposed second layer pole includes a through hole in axial alignment with said hole of said first layer pole, the penetrated fastener located in said hole of said first layer pole and said hole of said second layer pole.

Preferably, the penetrated fastener comprises a straight rigid tube or rod.

Preferably the rod is circular in cross section or other.

Preferably the penetrated fastener is a rigid pipe or round rod. It is preferably straight and elongate. Preferably having two opposed ends.

Preferably the penetrated fastener has a head at one end of the penetrated fastener to locate against the outer surface of the first layer pole and has a shank passing through the first layer pole and second layer pole, the penetrated fastener also having a threaded end opposite it's one end where the head is provided configured to receive a nut to be located on the outer surface of the second layer pole.

Preferably the penetrated fastener has a head at one end of the penetrated fastener to locate against the outer surface of the first layer pole and has a shank passing through the first layer pole and second layer pole and a vertical jack stud, the penetrated fastener having a threaded end opposite it's one end where the head is provided, configured to receive a nut to be located on an outer surface of the jack stud.

Preferably, the penetrated fastener is a dowel.

Preferably, the dowel is located in a blind hole of the first layer pole and a through hole of the second layer pole.

Preferably, the dowel has a diameter of at least 30 mm.

Preferably, the dowel has a diameter of 30 to 100 mm.

Preferably, the dowel has a diameter of 60 mm.

Preferably, the hole in which the dowel is located in has a diameter the same or greater than that of the dowel so as to form a locational fit.

Preferably, the hole in which the dowel is located in has a diameter 62 mm.

Preferably, a vertical jack stud is located above, and supported by, the second layer pole at a said intersection.

Preferably the vertical jack stud is located above and directly on the second layer pole at a said intersection.

Preferably the second layer pole between intersections.

Alternatively, a vertical jack stud is located above (preferably directly on) the respective pole both at an intersection and between intersections.

Preferably, the jack stud is of a pole shape.

Preferably, the jack stud has a scalloped end to thereat have a complementary fit with the respective pole the jack stud abuts.

Preferably the penetrated fastener penetrates the jack stud.

Preferably the penetrated fastener is located in a blind hole or bore in the first layer pole.

Preferably the jack stud has a blind hole extending into the jack stud from its bottom face up and into which a said penetrated fastener extends.

Preferably the jack stud is able to support one of timber joists, metal joists, flooring, bearers and framing of or for a structure to be supported above.

Preferably at each intersection where a said penetrated fastener is located, the penetrated fastener is pinned to the first layer pole by a first pin passing laterally through said penetrated fastener and at least partially through said first layer pole.

Preferably at each intersection where a said penetrated fastener is located, the penetrated fastener is pinned to the second layer pole by a second pin passing laterally through said penetrated fastener and at least partially through said second layer pole.

Preferably at each intersection where a said penetrated fastener is located, the penetrated fastener is pinned to the jack stud by a jack pin passing laterally through said penetrated fastener and at least partially through said jack stud.

Preferably, the penetrated fastener comprises a first orifice to accept said first pin.

Preferably, the first layer pole comprises a complementary first orifice to accept said first pin.

Preferably, the penetrated fastener comprises a second orifice to accept said second pin.

Preferably, the second layer pole comprises a complementary second orifice to accept said second pin.

Preferably, the penetrated fastener comprises a jack orifice to accept said jack pin.

Preferably, the jack stud comprises a complementary jack orifice to accept said second pin.

Preferably, one or more of the first pin, second pin and jack pin is composed of a material selected from one of stainless steel, mild steel, fibreglass, timber and plastics.

Preferably, the penetrated fastener is composed of a material selected from one of stainless steel, mild steel, fibreglass, timber and plastics.

Preferably, the pins are held within the respective orifices by clips, nuts or fasteners configured to attach at one or both ends of the respective pin.

Alternatively, the pins are located within the orifices by pressure and/or friction from the poles being compressed together.

Preferably the orifices and the complementary orifices have an easy running to locational clearance with the respective pins they locate.

Preferably the orifices and the complementary orifices have an interference fit with the respective pins they locate.

Preferably the pin or pins are straight and elongate.

Preferably the pins have a diameter between 3 and 30 mm.

Preferably the pins have a diameter of 17 mm.

Preferably the orifices have a diameter 1 mm greater than the pins they locate.

Preferably the orifices nave a diameter between 4 and 35 mm.

Preferably the orifices are 18 mm in diameter.

Preferably the penetrated fastener is tension.

Preferably the penetrated fastener, between the first layer pole pin and one or both of the second pole pin and jack stud pin is tension.

Preferably, the first layer poles and the second layer poles are held in a compressed manner at at least some intersections by said fastener.

Preferably the first layer poles and the second layer poles are held in a compressed manner at each said intersection by said fastener.

Preferably compression is kept between the first layer poles and the second layer poles by the introduction of the pins into the first orifice and at least one of either the second orifice or jack orifice, whilst the first layer poles and one or both of the second layer poles (and jack stud if provided) are under compression with each other.

Alternatively, the penetrated fastener has a threaded end at or protruding out of top of the second layer pole or jack stud that can receive a threaded fastener to clamp/compress poles together.

Alternatively, the first layer poles and the second layer poles are located together using a clevis type joint.

Preferably, there is no gap between abutting first layer pole and second layer pole at an intersection.

Preferably, there is no more than 5 mm between abutting first and second layer poles and/or second layer poles and jack studs.

Preferably, the two poles at an intersection are compressed towards each other via an actuated threaded rod, the rod torqued between 50 Nm and 150 Nm.

Preferably, the intersection is compressed using a torque of to 100 Nm.

Preferably the foundation is located on ground that directly supports the foundation.

Preferably the foundation is assembled from discrete poles in situ on said ground.

Preferably the foundation is able to be disassembled in a manner so that it can be re-assembled without repair, in another location.

Preferably the foundation is located in a pit created into ground.

Preferably, the base of the pit is levelled with a granular material lined with a lining and the foundation is located onto the lining.

Preferably the base of the pit is levelled with sand or other similar material, lined with a lining (e.g. geocloth) and the foundation is located (and preferably assembled) onto the geocloth.

Preferably, the foundation is at least in part embedded at least in part in earth that was removed to create the pit.

Preferably, the depth of the pit is at least 400 mm.

Preferably the depth of the pit is 550 mm.

Preferably, the depth of the pit is less than 700 mm.

Preferably the pit is lined with a lining (e.g. geocloth) or other suitable membrane for prevention of liquefaction induced flows into the foundation region.

Preferably, geocloth is intermediate the first layer poles and the ground which supports them.

Preferably, the foundation offers support for a concrete pad.

Preferably, the foundation is in-filled with a particulate filler (e.g. earth) and a concrete pad is supported on top of the particulate filler.

Preferably, the foundation is able to support a concrete pad above the jack studs.

Preferably, a concrete pad is supported by the jack studs.

Preferably, formwork is supported by the jack studs.

Preferably, the vertical jack studs extend through and above a concrete pad.

Preferably, the second layer poles are partially covered in concrete.

Preferably a concrete pad formwork is located on the second layer poles, the formwork having received a concrete pour and defining the base of the concrete pad.

Preferably the angle between the first layer poles and the second layer poles is 90 degrees.

Preferably the second layer may include at least one additional pole that is not parallel to the at least two poles of the second layer.

Preferably the first layer may include at least one additional pole that is not parallel to the at least two poles of the first layer.

Preferably the second layer may include at least one additional pole that is not fastened to at least one of the at least two poles of the second layer.

Preferably the first layer may include at least one additional pole that is not fastened to at least one of the at least two poles of the first layer.

Preferably, the poles have a minimum diameter of substantially 100 mm.

Preferably, the poles have a maximum diameter of substantially 275 mm.

Preferably the poles are each of a substantially constant cross section along their respective length.

Preferably, the poles have a diameter between 150 and 275 mm.

Preferably, the second layer poles have a smaller diameter than the first layer poles.

Preferably, the second layer poles have the same diameter as the first layer poles.

Preferably, the spaced parallel distance between poles of the same layer is between 1 and 3 meters.

Preferably, the poles are treated to prevent one or of the following; deterioration by insect, fungi, rot and moisture.

Preferably, the poles are made from timber logs that have been debarked and rounded.

Preferably, the poles are of a generally constant diameter.

Preferably, the length of a first layer pole is at least 3 meters.

Preferably, the length of a second layer pole is at least 3 meters.

Preferably, one or more of the first layer pole and second layer pole may be spliced together with a respective first layer pole or second layer of to form said length.

Preferably, the length is provided by a single pole.

Preferably, the foundation is be assembled and supported on 100 kPa ground.

Preferably, the foundation is capable of being disassembled and removed from site in a non-destructive manner.

Preferably, the foundation is located under a structure that has required remedial foundation support or maintenance.

Preferably the foundation has been retrofitted by assembly in-situ under a building structure.

Preferably the poles of each layer of poles are horizontal.

Preferably all the poles of each layer of poles are horizontal.

Preferably the poles of at least one layer of poles are at an angle to the horizontal.

Preferably, where provided, the jack stud extends vertically from the pole to which it is engaged.

Preferably all the poles of at least one layer of poles are at an angle to the horizontal.

Preferably the poles of at least one layer of poles are at an angle to the horizontal and the poles of the other layer of poles are horizontal.

Preferably the foundation is supported on sloping ground.

Preferably said layers are parallel to each other.

Preferably the second layer of poles are at an angle to at least the poles of the first layer on top of which they lie. This angle when seen in plan view is preferably 90 degrees.

Another aspect of the invention relates to a method of constructing a foundation comprising the following steps:

a. preparing a ground site by removing earth to form a pit with a substantially planar base,
b. placing a plurality of poles on the planar base to define a first layer of poles in the pit, and securing a plurality of poles to poles of the first layer to define a second layer of poles on top of the first layer of poles.

Preferably the poles that define the second layer are arranged at an angle to the poles of the first layer.

Preferably the angle is 90 degrees.

Preferably the layers are parallel to each other.

Preferably the planar base is horizontal.

Preferably the planar base is sloping.

Preferably, the method includes the step of providing a sheet material (eg geocloth) intermediate the pit base and the first layer.

Preferably, the method includes the step of providing sand or levelling material intermediate the pit base and the sheet material and/or first layer.

Preferably, the method includes the step of filling in the foundation containing pit with earth removed from the site to create the pit.

Preferably, the method includes the step of compacting the earth.

Preferably, the method includes the step of securing jack studs at one or more intersections.

Preferably, the method includes the step of providing a gravel base to the pit.

Another aspect of the invention relates to a method of constructing a foundation as herein described comprising a. preparing a ground site by removing earth to form a pit with a substantially planar base,
b. placing a plurality of poles on the planar base to define the first layer of poles in the pit, and securing a plurality of poles to poles of the first layer to define the second layer of poles on top of the first layer of poles.

Another aspect of the invention relates a ground bearing foundation of a grid of overlapping straight timber poles.

Preferably the poles are arranged so that a first layer of poles is provided that extend in a first plane and a second layer of poles is provided that extend in a second plane parallel to the first plane and wherein the poles of the first plane are not parallel to the poles of the second plane.

Another aspect of the invention relates to an in-situ assembled building foundation of a kind as herein described.

Another aspect of the invention relates a building supported on a foundation as herein described wherein the foundation is supported on ground.

Another aspect of the invention relates a building supported on a foundation as claimed in claim 1 wherein the foundation is supported on ground.

Another aspect of the invention relates to a timber pole grid foundation comprising an upper layer of spaced apart (preferably parallel) poles supported upon a parallel lower layer of spaced apart (preferably parallel) poles extending laterally to the poles of the upper layer, wherein the poles of the lower layer are fastened to the poles of the upper layer at at least some of the intersections between the lower layer poles and upper layer poles.

Another aspect of the invention relates to a method of stabilising a building supported on ground that has been adversely affected by changing ground conditions comprising assembling a foundation as described above for the building and causing the foundation to become vertically supporting of said building.

Preferably the assembling occurs beneath the building.

Preferably the assembling occurs adjacent the building and the building is subsequently shifted to be supported on top of the foundation.

Preferably the building is able to be moved over the foundation and the or some of the jack studs are installed after the building is located above the foundation, the connection between the building and the jack studs being established after the jack studs are secured to the poles of the first and/or second layer.

Another aspect of the invention relates to a foundation construction for a building located above sloping ground, comprising a. at a first plateau established at a first level of said sloping ground, a first foundation as described above
b. at a second plateau established at a second level of said sloping ground that is above the first level, a second foundation as described above
c. a plurality of upwardly from said first level extending poles (herein after "retaining poles") each secured to one of (a) a pole of said first layer of said first foundation and (b) a pole of said second layer of said first foundation, at a lower end of said retaining poles and to one of (a) a pole of said first layer of said second foundation and (b) a pole of said second layer of said second foundation, at an upper end of said retaining poles.

Preferably the retaining poles are secured by being fastened at their upper and lower ends to respective poles of the foundations.

Preferably the retaining poles area adapted and configured to bear against the poles of the upper and lower foundations and thereby be secured thereby.

Preferably the retaining poles extend parallel to each other.

Preferably the retaining poles are spaced from each other to be able to provide a soil retaining function to the ground extending between the two plateaus.

Preferably the retaining poles laterally abut each other.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.)

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10).

BRIEF DESCRIPTION OF THE DRAWINGS

The invention will now be described by way of example only and with reference to the drawings in which.

DETAILED DESCRIPTION OF THE INVENTION

Figure 1:
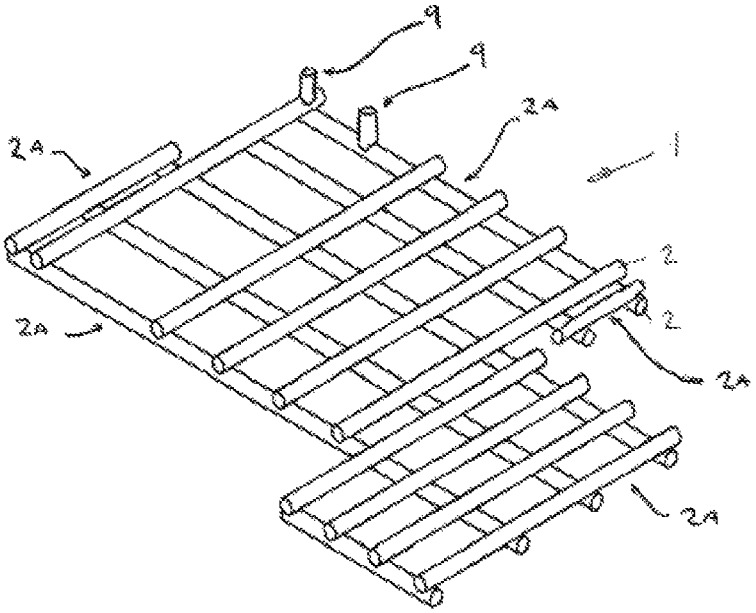
FIG. 1 shows a perspective view of an assembled foundation.
Figure 2:
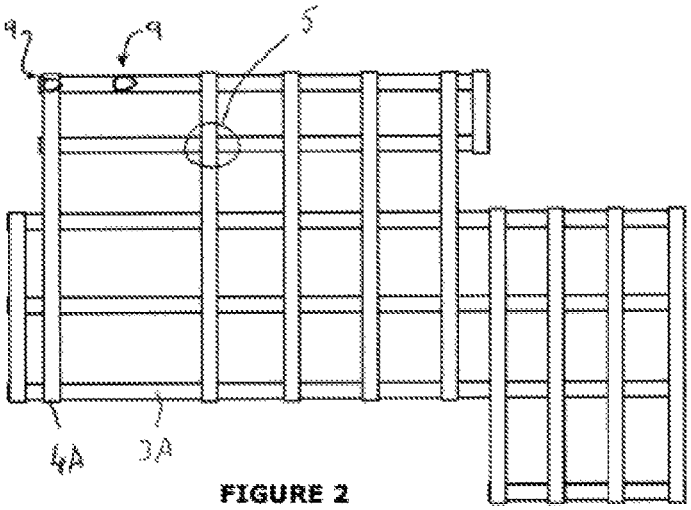
FIG. 2 shows a plan view of an assembled foundation.
Figure 3:
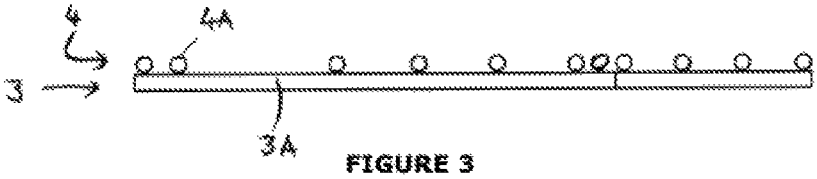
FIG. 3 shows a side view of an assembled foundation.
Figure 17:
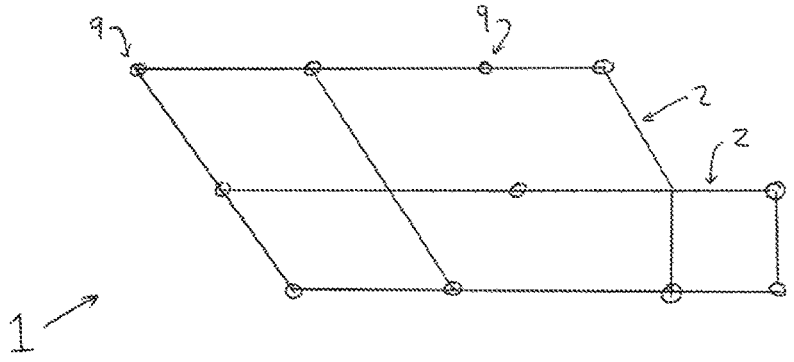
FIG. 17 shows a schematic plan view of an alternative embodiment of a foundation of the present invention.

With reference to FIG. 1 there is shown an example of a foundation structure 1 in a perspective view. A similar foundation structure is shown in plan in FIG. 2 and as a side view in FIG. 3. FIGS. 1-3 are merely an example of a shape that a foundation structure as herein described may assume. An alternative shape is shown in FIG. 17. Many other variations in shape and configuration are anticipated and a person skilled in the art will understand such variations based on the description about the foundation structure that will herein now be described.

The foundation is able to be used a number or purposes. Such purposes may be; a foundation for a residential building 9, commercial buildings, roadway foundations, construction pads, temporary pads, railway line foundations, foundations for agricultural buildings and so on.

The foundation structure 1 preferably comprises of a plurality of poles 2. The poles are preferably timber poles. They are preferably elongate and are substantially round in cross section. They are preferably of a substantially constant cross section.

The poles are of a substantial length so that they can span a substantial distance. In the preferred form at least one and preferably a plurality of the poles used in the foundation structure are at least three meters long and preferably over four meters long.

The plurality of poles are arranged in a grid-like manner as can clearly be seen in FIG. 2. There is preferably a first layer of poles 3 and a second layer of poles 4. The first layer of poles is preferably the lower layer of poles and the second layer of poles are preferably the upper layer of poles. For example poles 3A of the lower level extends substantially horizontally when in situ. Likewise poles 4A of the upper level 4 extends substantially horizontally when in situ. In the preferred form the poles 4A of the second level lie on top of poles 3A of the first level. This can be seen in FIGS. 1 and 3. Some nesting at the intersections may be provided for by virtue of a cut-out or scallop being provided poles of one or both of the levels. In the preferred form no such cut-out or scalloping is provided.

In the preferred form the poles 4A of the upper level extend at an angle to the poles 3A of the lower level. In the preferred form the poles of the upper level are substantially parallel to each other. In the preferred form the poles of the lower level are substantially parallel each other. In the preferred form the poles of the lower level extend at a right angle to the poles of the upper level. It will be appreciated that the poles of the lower level may extend at another angle relative to the poles of the upper level. This can be seen in FIG. 17. So long as the poles of the lower level are arranged to at least overlap with some of the poles of the upper level it can be seen that at least one (and preferably a plurality) of upper to lower level pole intersections 5 are created.

It is at these intersections that the poles of upper layer cross over the lower layer poles. Here, the fastening of the upper layer to the lower layer occurs. Furthermore, at these intersections, jack studs may also be fastened using the same or another fastening arrangement as is used for pole to pole fastening.

The fastening of the lower level poles to the upper level poles at at least one and preferably each of the intersections of the foundation will hereinafter be described in more detail.

Figure 4:
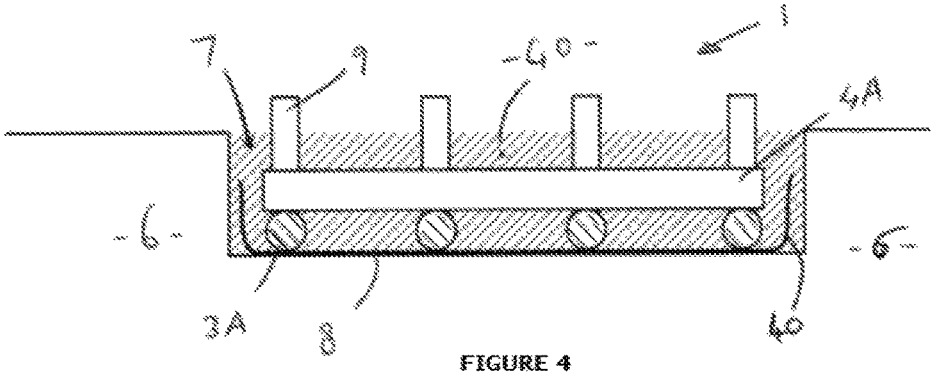
FIG. 4 shows a side cross sectional view of an assembled foundation in a pit.
Figure 5:
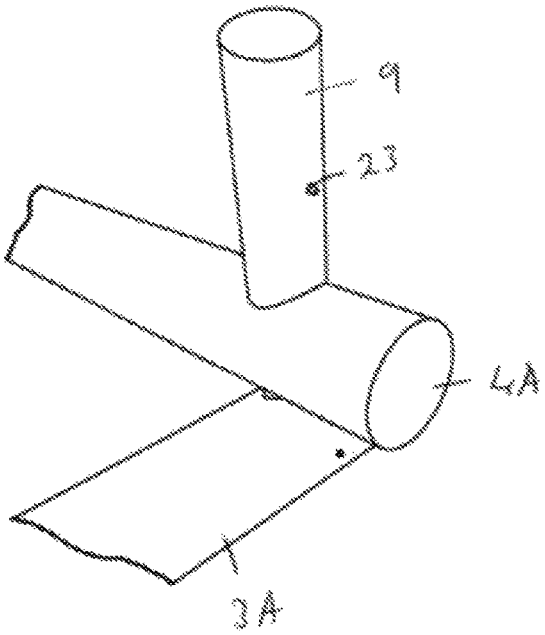
FIG. 5 shows a breakout perspective view of at an assembled intersection.
Figure 18:
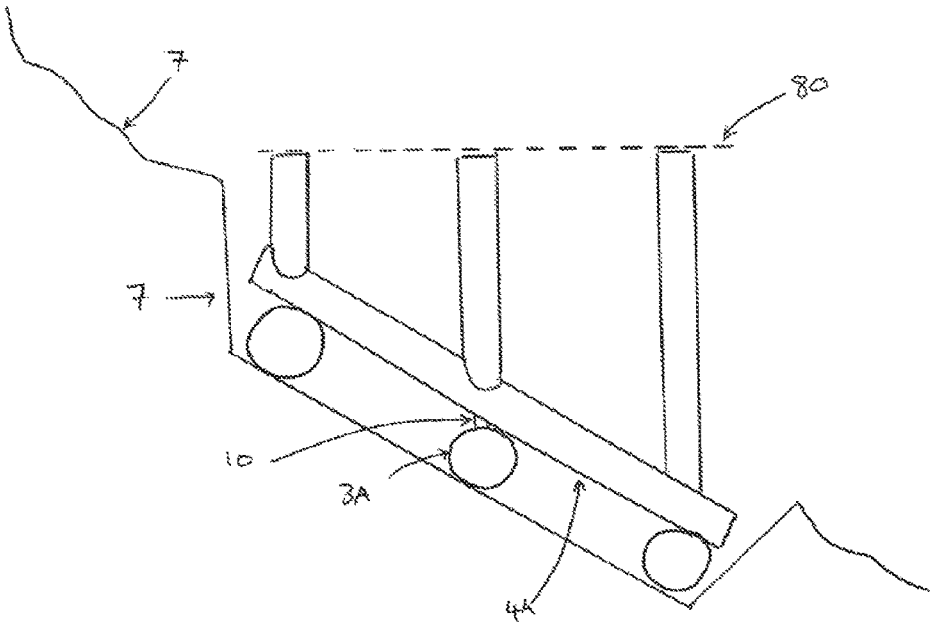
FIG. 18 shows a schematic side view of a sloping embodiment of a foundation of the resent invention.

With reference to FIG. 4 it can be seen that the foundation structure 1 is able to be supported on the ground 6. The foundation structure 1 may be supported in a pit 7 that is created in-ground. The pit 7 maybe of a plan perimeter shape to closely match the perimeter shape of the foundation structure 1. The pit 7 is preferably a shallow pit and has a base 8 that is substantially level. The pit 7 may also be located on a slope as shown in FIG. 18. The foundation preferably bears directly onto the ground.

The level base of the pit provides the platform for supporting the lower level poles of the foundation structure. Given that the poles are preferably elongate and straight a substantially level base 8 will provide substantially uniform support to each of the lower level poles. Preferably the level base 8 is within a tolerance of 50 mm in vertical height. The levelling can be achieved by introducing a finer material such as sand into the bit that is easily spreadable to give a level base. Alternately, the pit itself may dug level from the outset.

The foundation structure may alternatively be placed or constructed on the upper surface of the ground 6 without being set at least partially into a pit. Advantages in placing or constructing the foundation structure 1 in a pit will hereinafter be described.

Using timber poles (which are rigid but have some capacity to resiliently flex and are tough) that are of a substantial length, load distribution of the structure supported by the foundation to the ground below can be provided in well distributed manner.

In some forms the foundation structure may include a plurality of jack studs 9. These jack studs 9 are preferably engaged to at least one and preferably a plurality of upper level poles. Preferably the jack studs 9 have a complementary scalloped recess to fit snugly against the respective pole that supports it. Jack studs will hereinafter be described in more detail.

The top of the jack studs are configured to support a structure. The structure may be a building or pad any other structure that needs a foundation to be connected to.

Within the pit an optional lining 40 may be provided. The lining 40 may be of durable and preferably waterproof material. The foundation structure 1 may be placed or constructed on such lining material to separate the foundation structure from contacting at least part and preferably all of the base 8 of the pit or the ground on which the foundation structure is supported. The lining 40 can divert any ground liquefaction flow. It may prevent such liquefaction from coming up through the foundation structure. It can be seen in FIG. 4 that the lining 40 is upturned on its edges. This is an optional upturn and instead the lining 40 may be substantially flat and may have in some locations apertures therethrough to help with water drainage in a downward direction into the ground below the foundation structure. In further embodiments the lining 40 extends up the sides of the pit to ground level.

In the most preferred form the foundation structure 1 is assembled in situ. In the situation where the foundation structure is to be set at least partially into a pit 7, the pit after having been created can receive the plurality of poles so as to be arranged in the pit in the grid-like manner that is preferred and as described herein. Preferably some, and more desirably all, of the lower level poles 3A are moved into the pit whereafter the upper level poles can be laid laterally or diagonally on top of some and preferably most if not all of the lower level poles.

In some forms the poles are prefabricated for the purposes of fastening the poles together at at least one and preferably each intersection of the upper and lower level poles. In an alternative the poles can receive fasteners without such pre-fabrication having been done or required. In some forms the provision of fastening features for fastening the poles together occurs in situ and such will hereinafter be described with reference to the accompanying drawings.

Figure 6:
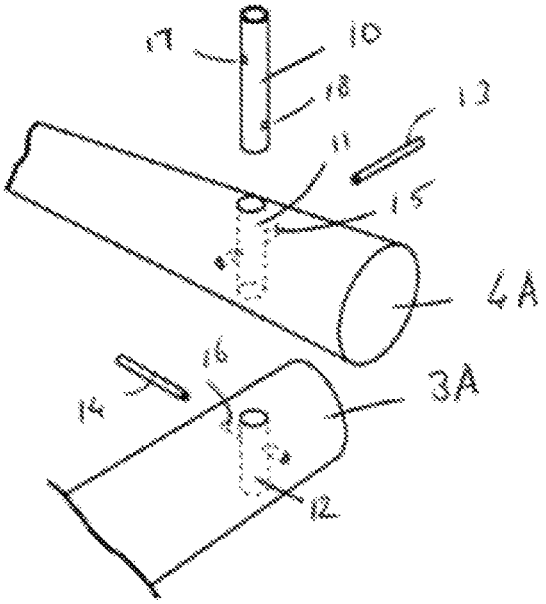
FIG. 6 shows a perspective view of an alternative embodiment without a jack stud.
Figure 7:
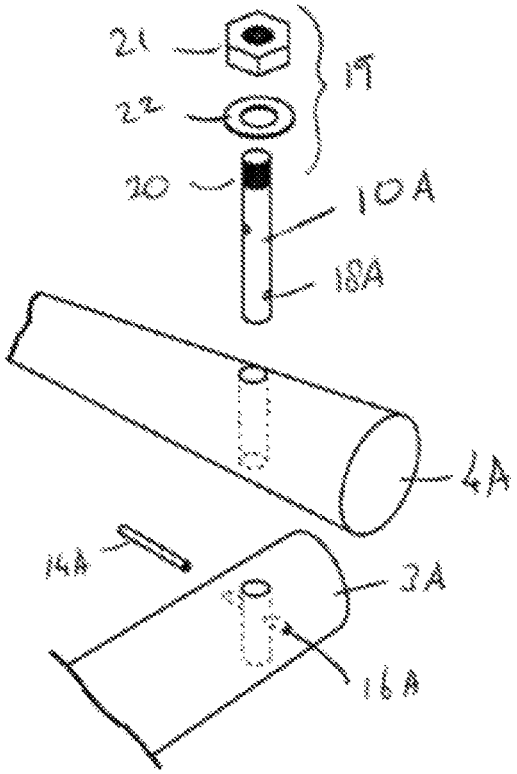
FIG. 7 shows a perspective view of an alternative embodiment with a threaded fastener.

With reference to FIGS. 6 and 7 one example of a fastening arrangement between the upper and lower level poles is shown. With reference to FIG. 6 a dowel 10 is provided to be located in a hole 11 of the upper level pole 4A. An axially aligned hole 12 of the lower level pole allows for the dowel 10 to be located therein. The dowel preferably hence extends between the upper and lower level poles at an intersection region 5.

The dowel 10 is located in the hole 11 and hole 12 to prevent lateral sliding (shear) movement between the poles at that intersection.

The dowel 10 may be a tube or a rod and is preferably of a rigid material such as a composite material or a metal material. It may instead be of timber. The dowel may have a circular, square or other shaped cross section. It is preferably straight, elongate and sufficiently long to be able to extend to a sufficient extent in an upper and lower level pole at an intersection.

The dowel needs to be able to resist relative horizontal movement between the upper and lower level. It should preferably also be able to act in tension to prevent vertical separation of upper and lower levels. It preferably also is be able to act in compression. The dowel may have a diameter of at least 30 mm, or a diameter between 30 and 100 mm. As a tube, the dowel preferably has a diameter of 60 mm and a wall thickness of 4 mm.

Preferably, the hole in which the dowel is located in has a diameter greater than that of the dowel so as to form a locational fit. Preferably, the hole in which the dowel is located in has a diameter 62 mm. The hole to locate the dowel is preferably the same or larger than the dowel, yet still be able to locate the dowel is a snug manner. The preferred drilling process as will herein be described should hence be performed sufficiently accurately.

In one foundation structure a plurality of dowels may be used. Some may be of a different size to others. Some may be of a different length to others. Some may be cut to length on site. At least two different lengths are preferably provided, depending on whether used with fastening a jack stud or not. In one embodiment shown in FIG. 11, the dowel is 830 mm long. This length is approximately equal to sum of the lengths of the holes within the upper and lower layer poles and jack stud. In embodiments with no jack stud, FIG. 7, the dowel may only be 550 mm long. A person skilled in the art will realise these lengths are not specific.

Preferably a vertical separation between the poles, and to hold the poles together in a vertical orientation, is achieved by the dowel 10 being secured, preferably by pinning to both the upper level pole 4A and the lower level pole 3A. This is preferably achieved by pins 13 and 14 that respectively extend into lateral holes 15 and 16 of the upper and lower level poles 4A, 3A. The pins extend into and preferably through the dowel by virtue of the dowel having matching apertures 17 and 18. In one embodiment the dowel may have a friction fit with hole 11 and hole 12 and not use pins or other fasteners.

In the preferred form the holes 11 and 12 extend substantially in a radial direction to the central axis of the elongate poles. Similarly the holes 15 and 16 for the pins extend radially and preferably perpendicular to the respective holes 11 and 12. In the preferred form the holes 15 and 16 are through holes through each of the poles and are dissected by the holes 11 and 12 in which the dowel 10 is located.

In the preferred form the hole 12 is preferably a blind hole whereas the hole 11 is preferably a through hole. The through hole is provided as a result of the in situ provision of the features of the foundation structure that fasten the poles at an intersection together.

Alternative fasteners may be used for fastening the poles at an intersection together. One such alternative is shown in FIG. 7 where the dowel 10A is provisioned with a hole 18A to receive the pin 14A extending into the hole 16A of the lower pole 3A but no pin is provided for securing the dowel to the upper pole 4A and instead a threaded fastening arrangement 19 is provided at a distal end of the dowel 10A.

The third fastening arrangement may include a male threaded region 20 of the dowel and a female threaded member such as a nut 21 that can be threadingly fastened and react against an upper surface of the upper pole 4A directly or via a washer 22 or other load spreading member.

Figure 8:
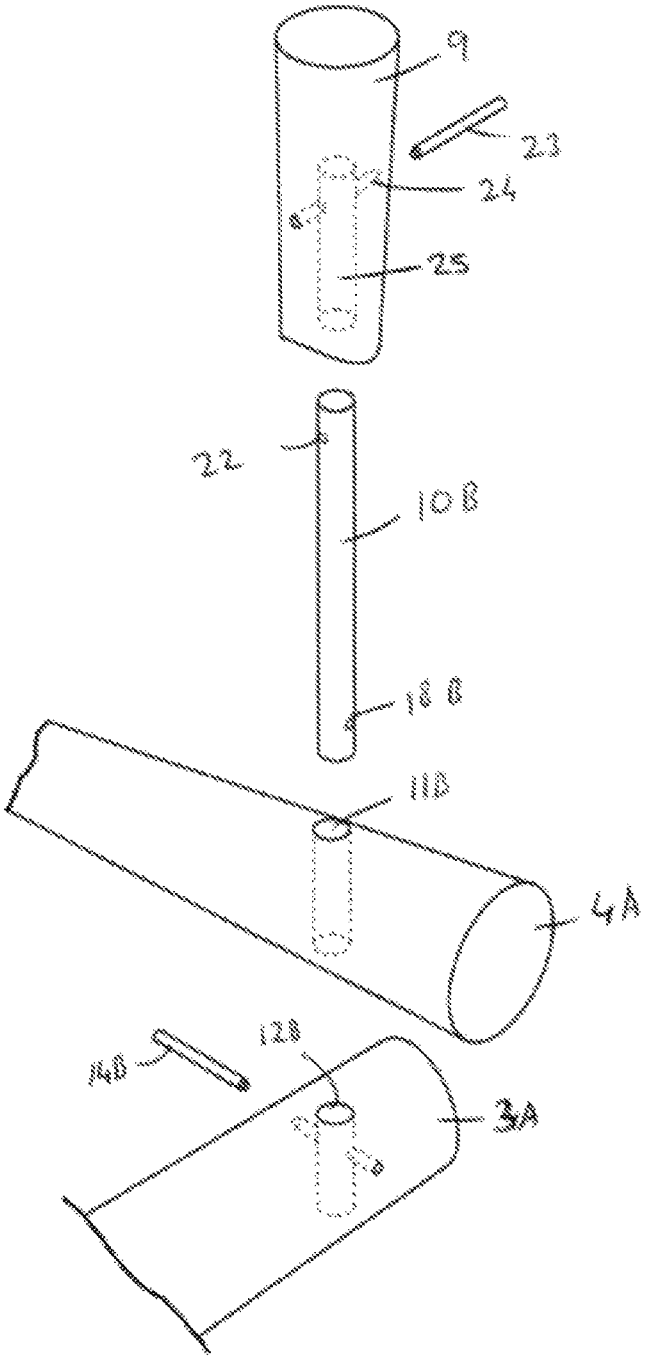
FIG. 8 shows an exploded perspective view of an intersection.

With reference to FIG. 8 in a preferred form where a jack stud is provided, the jack stud is provided at an intersection between an upper level pole 4A and a lower level pole 3A. The jack stud 9 is preferably secured using the dowel 10B. The dowel 10B in a similar manner to the dowel described with reference to FIG. 6 is provided in a hole 11B of an upper level pole 4A and extends into the hole 12B of the lower level pole 3A. The hole 11B and 12B are axially aligned so that the dowel 10B can extend in both holes 11B and 12B. Whilst the dowel 10B may be pinned to the upper level pole 4A as well as the lower level pole 3A in one form no such pinning occurs with the upper level pole 4A. Instead the dowel 10B is fastened to the jack stud 9. The jack stud 9 may include a blind or through hole 25 that can receive the dowel 10B.

Preferably the jack stud is pinned in a similar fashion to the lower pole as it is to the upper pole. The dowel 10B may be provided with a hole 22 to receive the pin 23 that extends in through the lateral hole 24 of the jack stud 9 to allow for the pin 23 to reach the dowel and penetrate into the hole 22 of the dowel and preferably therethrough. This allows for a pinning of the dowel to both the jack stud 9 and the lower level pole 3A and thereby secure in a vertical direction the jack stud 9 with the upper level pole 4A and the lower level pole 3A.

Figure 8A:
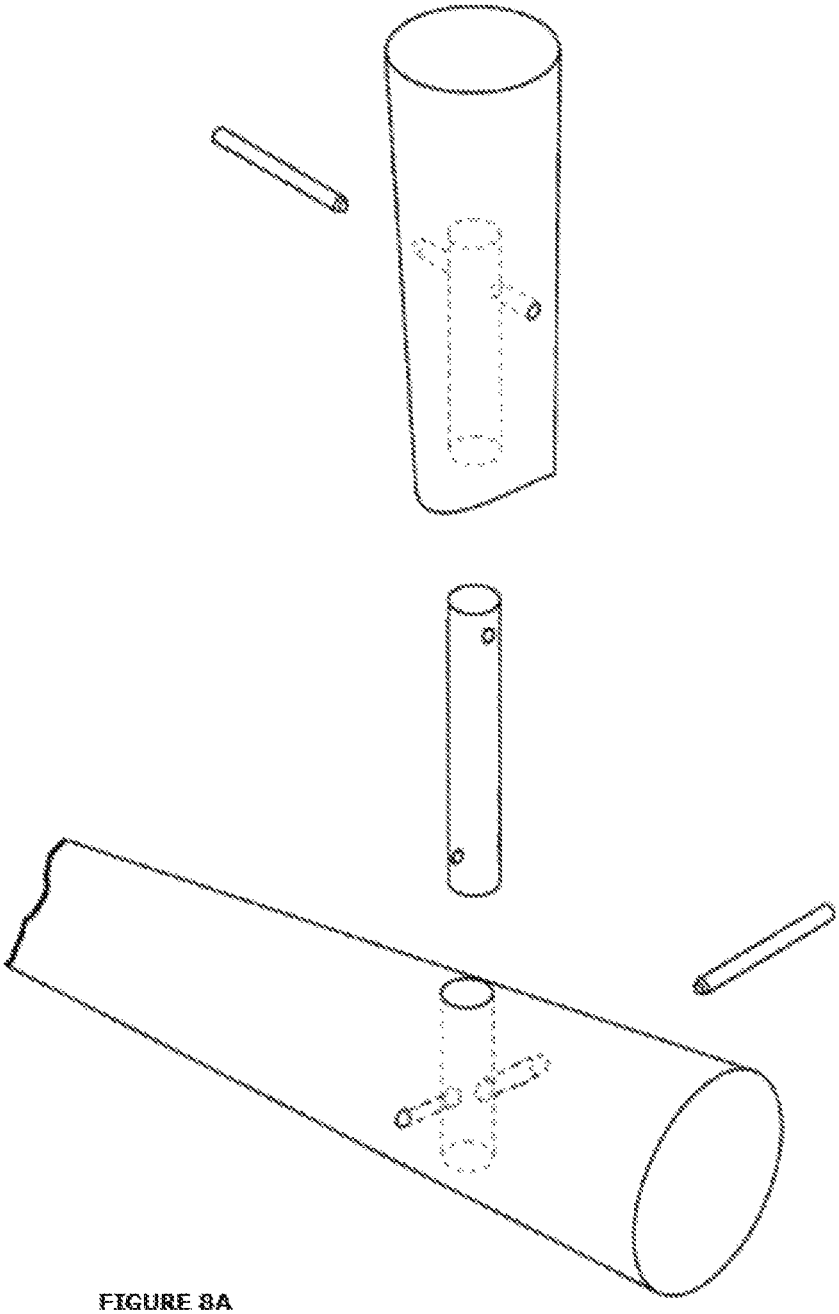
FIG. 8A shows an exploded perspective view of an intersection of a different embodiment.
Figure 10:
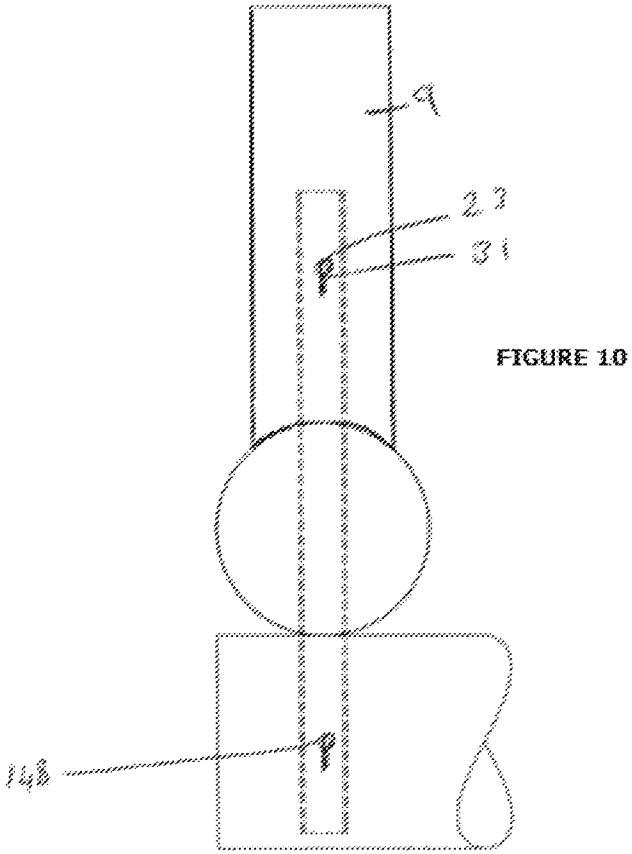
FIG. 10 shows an end view of an assembled intersection.
Figure 9:
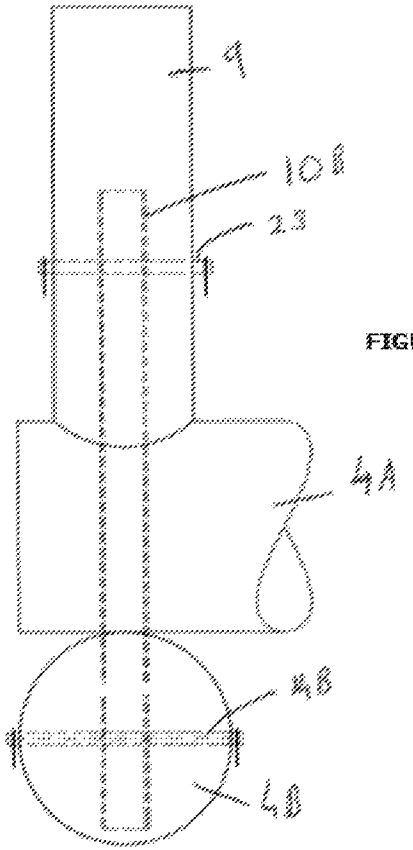
FIG. 9 shows a side view of an assembled intersection.

In FIG. 8 the hole 25 of the jack stud is preferably a blind hole and likewise the hole 12B in the lower level pole 3A is also a blind hole. FIGS. 9 and 10 show side and end views of the assembled version of the exploded view shown in FIG. 8. Preferably the pin 23 and the pin 14B extend parallel to each other although in an alternative configuration as shown in FIG. 8A they are perpendicular each other. Preferably the pins are elongate straight pins that extend perpendicular to the elongate direction of the dowel. The dowel in situ preferably extends substantially vertically whereas the pins extend substantially horizontally and parallel to the elongate directions of the respective upper and lower level poles.

The jack stud may be at least partially coated with a plastics coating to prevent detriment to the jack stud. Preferably, the jack stud is at least partially coated with a polyethylene shroud.

In the preferred form the pins are composed of a metal material such as a stainless steel. Alternatively the pins are composed of a plastics or composites material. They are able to snugly fit into the apertures or holes of the dowel and thereby ensure that the dowel is securely connected to the components of the foundation structure. R-pins or split pins 31 may be provided to help ensure the pins remain in position. Alternatively the holes into which the pins are pushed may provide a snug fit with the pin. Preferably the pins have a running, locational or interference tolerance fit with their respective holes. For example the pins may need to be driven in by a mallet or hammer. Preferably the pin holes have a diameter 1 mm greater than the pins they locate. Preferably the pin holes have a diameter between 4 and 35 mm. Preferably the holes are 18 mm in diameter.

The pins may have a diameter between 3 and 30 mm. Preferably the pins have a diameter of 17 mm. A person skilled in the art will realise many different size pins can be used. The size of the pin determined by how much pressure is put on the assembly, what the pin material is, and many other factors.

Figure 11:
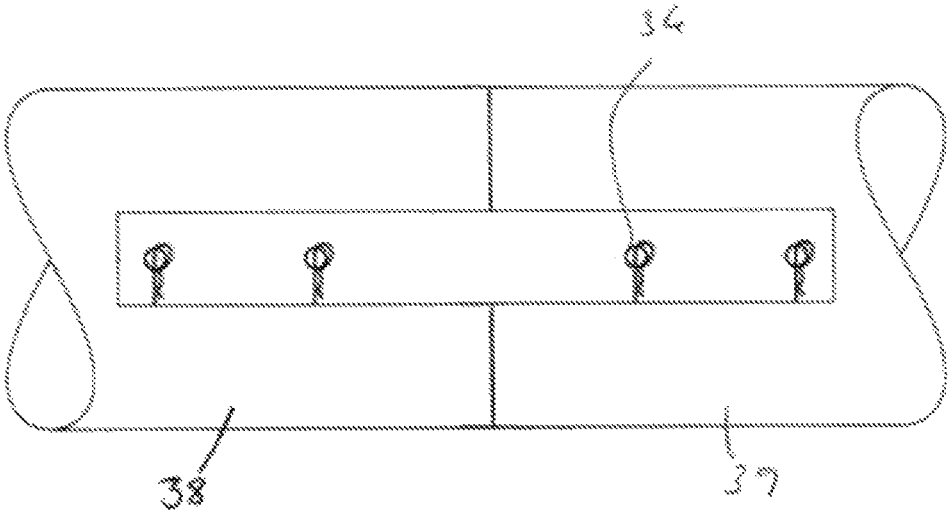
FIG. 11 shows a side view of a spliced pole.
Figure 12:
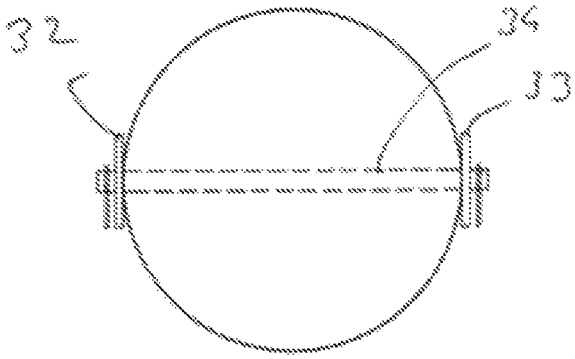
FIG. 12 shows an end view of a spliced pole.

With reference to FIGS. 11 and 12 it can be seen that if a pole is not sufficiently long to provide a continuous span in a particular direction, poles can be end to end joined by a splint-like arrangement. The splint arrangement may include side plates 32 and 33 that are rigid and elongate and provide some resistance against bending of the composite pole when assembled. The plates 32 and 33 are preferably securely joined to each of the poles by fasteners that for example may come in the form of fastening pins 34 that pass through each of the two poles 38 and 39. There are other ways of end to end joining poles to provide a longer effective span.

In the preferred form each pole has a substantial span. Preferably at least two of the poles at each level are located at a peripheral region of the foundation structure. Preferably between such peripheral poles 2A at a level, at least one of the poles at the other level extends substantially between such peripheral poles. This helps create a foundation structure that provides resistance against subsidence of the foundation structure. Should part of the ground below the foundation structure subside and a pole previously being vertically supported at such subsidence is then left unsupported thereat, the rigidity of the pole itself and that of the at least one pole above to which is secured, will help reduce or prevent movement of foundation.

The poles have a diameter greater than a 100 mm and more preferably in one embodiment they are 275 mm in diameter. The diameters of the poles need to be sufficient for the forces present in the assembly and the jig (later described) needs to be designed and dimensioned appropriately.

Preferably, the spaced parallel distance between poles of the same layer is between 1 and 3 meters. Spacing of the poles depends on the structure the foundation needs to support. Heavier structures will require closer spacing. Other factors such as ground type, local laws, environs, timber or materials used, cost will dictate the desired spacing between poles.

Preferably, the poles are treated to prevent one or of the following; deterioration by insect, fungi, rot and moisture. Preferably, the poles are debarked and rounded to a generally constant diameter. However it is appreciated the timber poles will have deviations of diameter and trueness and this is acceptable and accounted for in the design of the current invention. In some embodiments, the timber poles may have one or more flat or facetted surfaces. The flat surfaces may be adjacent each other where a pole is laid on top of another pole. Alternatively the poles may be oval or ellipse shaped.

In some embodiments the assembly of the foundation is not perpendicular grid like as shown in FIG. 17. It is appreciated that a person skilled in the art will realise this system is versatile and many different variations for different sites, uses and structures are applicable.

The foundation structure as shown in FIG. 4 is preferably located in a pit 7. The pit 7 is preferably a pit that has been created prior to establishing the foundation structure therein.

The depth of the pit is at least 400 mm. In some embodiments the top of the upper layer poles may protrude above the surrounding ground surface. Preferably the depth of the pit is 550 mm. Preferably, the depth of the pit is less than 800 mm. A typical prior art foundation (Type 2A, 2B, or 3A) for a timber floor type may have a pit 800 mm-1000 mm deep.

After assembly of the foundation in the pit, the earth/soil removed from the pit to create the pit is at least in part re-introduced back into the pit. This soil 40 at least partially embeds the foundation structure in soil within the pit. A compacting of the soil may take place. One of the advantages of reintroducing at least some of the soil when moved to create the pit, back into the pit, is that less soil then is required to be disposed of or placed elsewhere on or offsite.

With a grid-like structure of the foundation structure of the present invention a substantial amount of volume remains in the pit after the foundation structure being established therein, that volume able to be re-occupied by the soil previously removed from the pit. This therefore means that a reduced amount of remaining soil removed from the pit is required to be disposed of or used elsewhere on or offsite. This is of particular advantage for a site where the soil may be contaminated or is of a quality that makes it expensive for it to be disposed of, offsite. The fact that a lot, if not all (if compacted) of the soil removed to create the pit can be reintroduced into the pit after the foundation structure has been established therein means that less site soil needs to be taken offsite.

An alternative version of the foundation structure of the present invention where no jack studs are provided includes one where a concrete pad is able to be supported on or by the foundation structure.

Figure 13A:
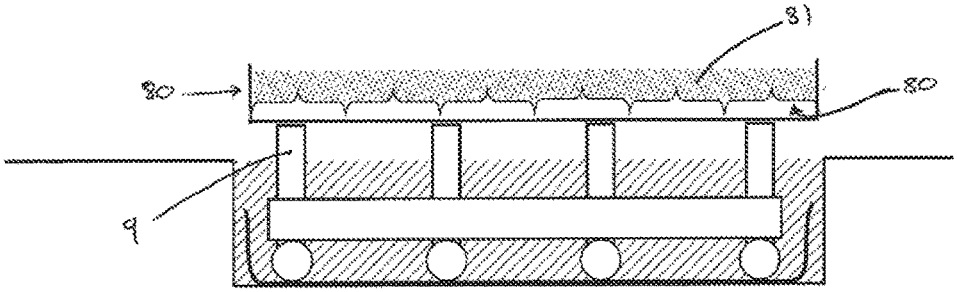
FIG. 13A shows a side view of an assembled foundation in a pit supporting a formwork and concrete slab above the jack studs.
Figure 13B:
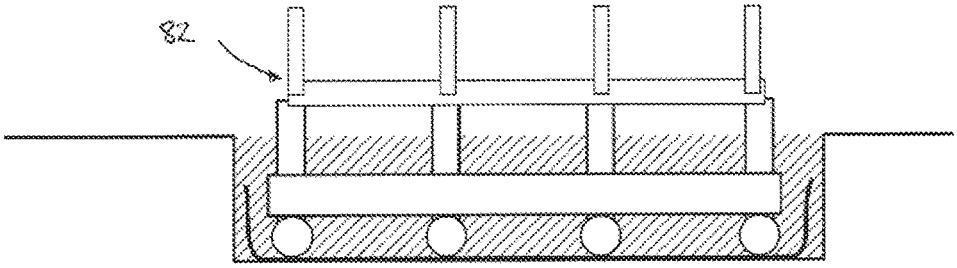
FIG. 13B shows a side view of an assembled foundation in a pit supporting a framework by the jack studs.

With reference to FIGS. 13A, B, and D there is shown various support embodiments. FIG. 13A shows a raised formwork 80 retaining a concrete slab 81 supported by the jack studs 9. FIG. 13B shows a framing system 82, including bearers or joists supported by the jack studs 9.

Figure 13C:
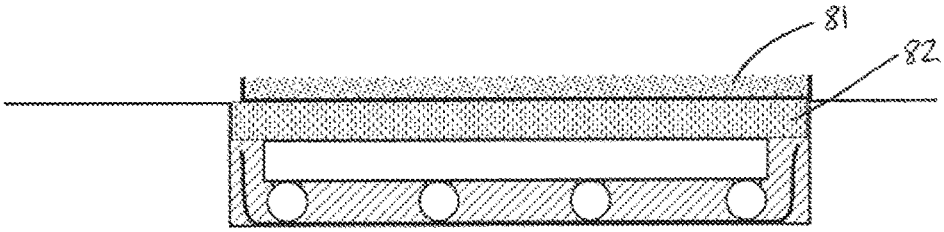
FIG. 13C shows a side view of an assembled foundation in a pit supporting a gravel raft and concrete slab.

FIG. 13C shows a concrete slab 81 supported by the foundation, preferably with a gravel raft 82 and/or lining intermediate the earth and the concrete slab.

Figure 13D:
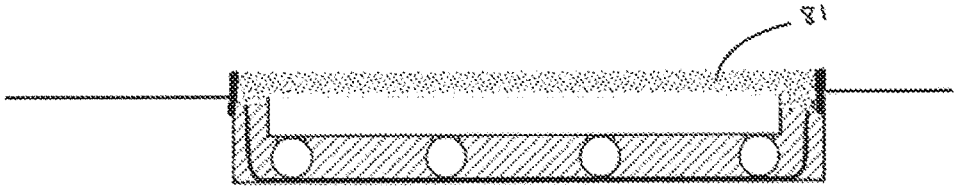
FIG. 13D shows a side view of an assembled foundation in a pit directly supporting a concrete slab.

In a further embodiment, as shown in FIG. 13D, the concrete slab 81 at least partially covers the second layer of poles.

Preferably, the foundation is able to be installed under buildings that require remedial foundations or maintenance.

Figure 21:
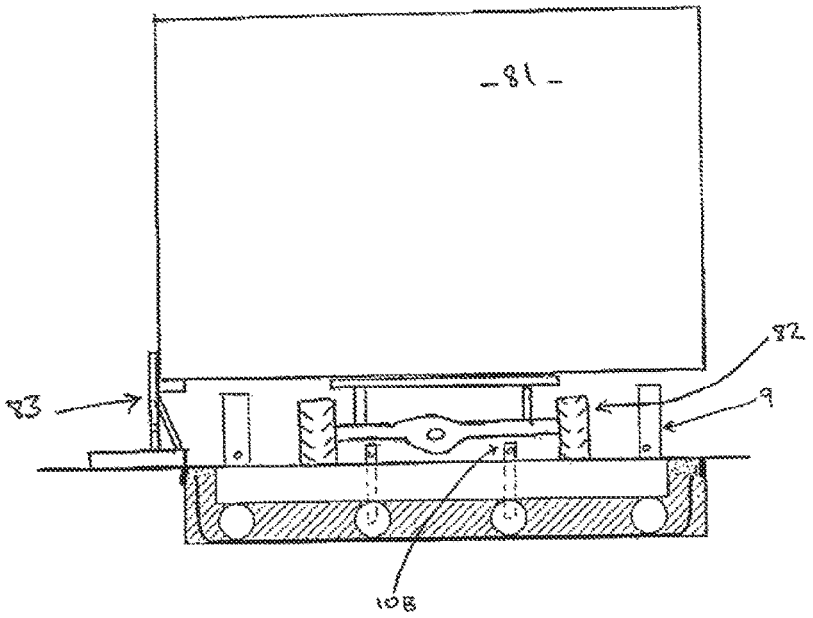
FIG. 21 a schematic side view of a drive through embodiment of a foundation with some of the jack studs removed or not installed.

As described above, the top of the jack studs are configured to support a structure. In one example the jack studs are connected to a building. The jack studs may be connected to various types of building structures or features such as wooden or steel bearers or framework. In one embodiment a house or building 81 is to be located onto the jack studs, where the building is prebuilt. The prebuilt building 81 is transported via a vehicle 82 to the foundation site. As the as the jack studs are typically extending higher out of the ground than the height of the vehicle 82 above the ground, it may be preferable to remove a series of jack studs so a vehicle may drive over the foundation without hindrance of hitting the jack studs. The building 81 is lifted up off the truck via supports or a jacking system 83 and the unburdened truck is driven off the foundation site. The building 81 is then lowered downwards onto the existing jack studs, or further jack studs installed where they were once removed, and then the building connected to the jack studs. The dowels may be left remaining in place with the first and second layer poles, yet be low enough to allow a truck to drive over them as shown in FIG. 21

In other embodiments, the vehicle can drive between jack studs, so there is no need to remove any jack studs.

Figure 19:
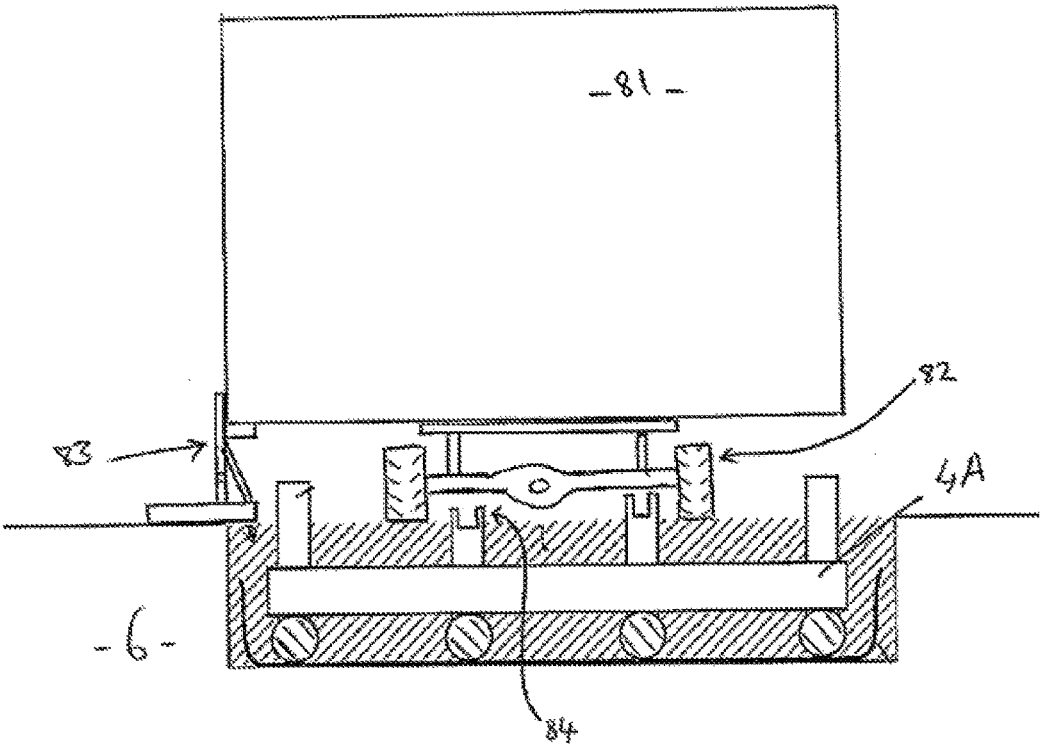
FIG. 19 shows a schematic side view of a drive through 2 part jack stud embodiment of a foundation of the present invention.
Figure 20:
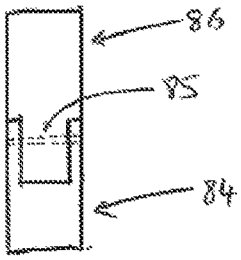
FIG. 20 shows a schematic side view of a 2 part jack stud as used in a drive through embodiment.

In a further embodiment, the jack studs are of a two or more part form as shown in FIG. 19. In the two-part form jack stud, the lower part 84 of the jack stud is fixed to the foundation, and extends out of the ground lower than the height of the clearance of a structure burdened vehicle above the ground to allow the vehicle to drive over the lower part of the jack stud. Once the vehicle has located the building in the correct place and driven away, the upper part 85 of the jack stud can be connected to the lower part 84 of the jack stud so the jack stud extends to its operative height. The lower part of the jack stud may merely be a fixture to attach the jack stud to. The lower part 84 and upper part 85 may be joined by a pin 85 as shown in FIG. 20.

In an alternative embodiment, the foundation is installed at least partially on a slope 7. The design of this angled system is essentially the same as the horizontal system apart from the jack studs if present. If jack studs are required, they are located off the intersections as usual, between the bottom layer poles and top layer poles, however they are vertical. The vertical jack studs are of different heights down the slope 7, so the jack studs are able to form a top bearing plane 80 that is level to support a level structure. The bottom layer poles in a preferred embodiment will be laid perpendicular to the slope as shown in FIG. 18 to more effectively resist sliding down the slope.

Figure 22:
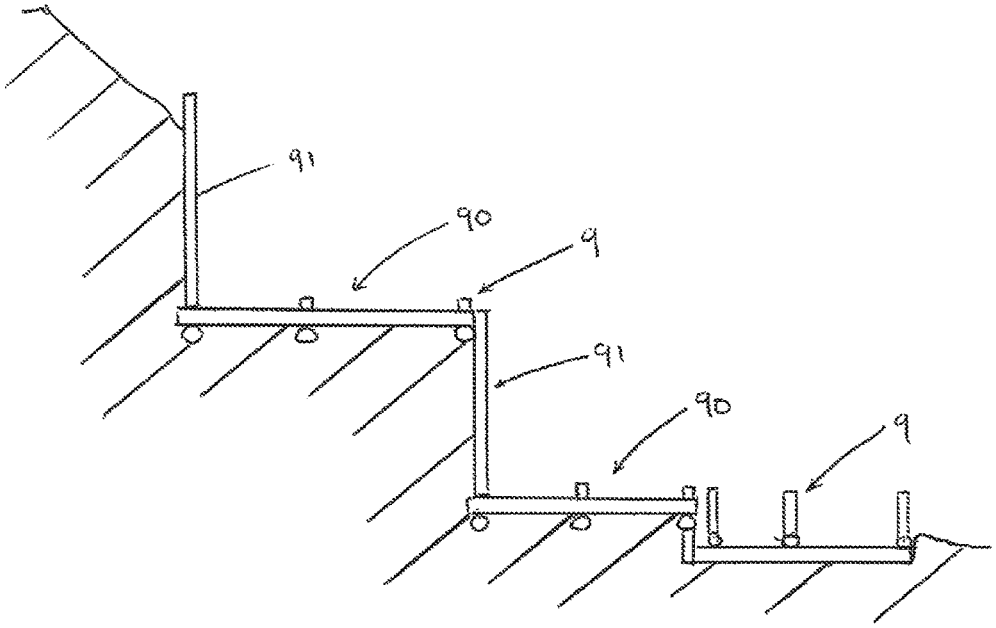
FIG. 22 shows a schematic side view of a terraced embodiment of a foundation of the present invention.

As shown in FIG. 22, the foundation structure may be used in a tiered or terraced fashion. In a terraced fashion, the foundation structure consists of more than one substantially parallel and offset level foundations 90. Pits may be dug into these terraces to locate the foundations. Preferably these offset terraced foundations 90 are tied together vertically. The tying may be done in the form of extended jack studs 91. The extended jack studs may also form part of a retaining wall. The wall may be fully or partially joined to adjacent terrace foundations 90.

The tying may also be done in a sloped fashion, with a sloped retaining wall. Alternatively the sloped wall may be of the manner of the sloped foundation described above and shown in FIG. 18.

Many of the above embodiments may be combined depending on site and structure supporting requirements. This is due to the versatile nature of the present invention.

The foundation herein described is able to be moved if subsidence of it does occur. At least one or more poles can be lifted or jacked up to reposition the foundation. Propping of the foundation can then occur to re-stabilise the foundation in its repositioned condition.

Figure 14:
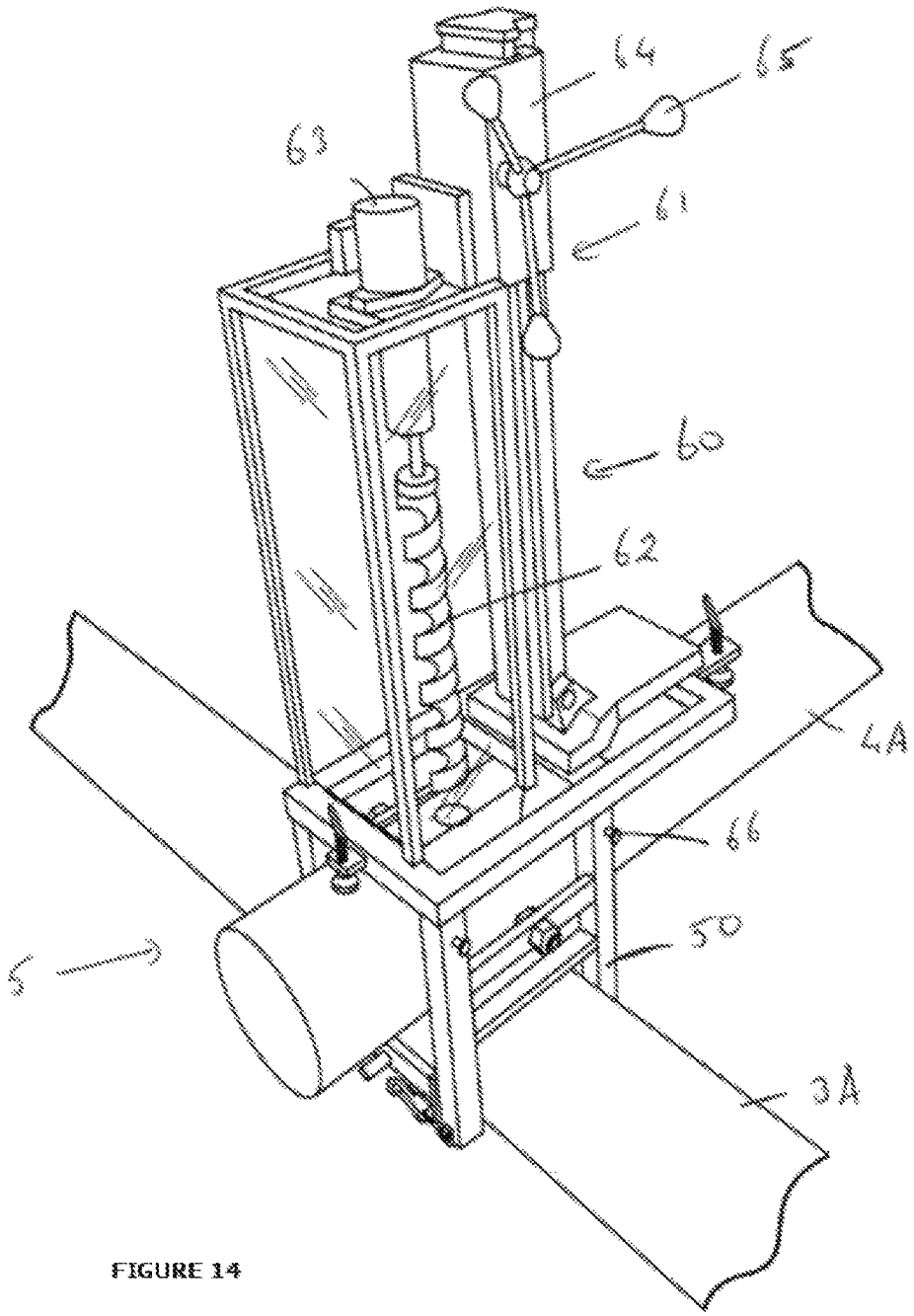
FIG. 14 shows a boring attachment and substructure located at an intersection.
Figure 15:
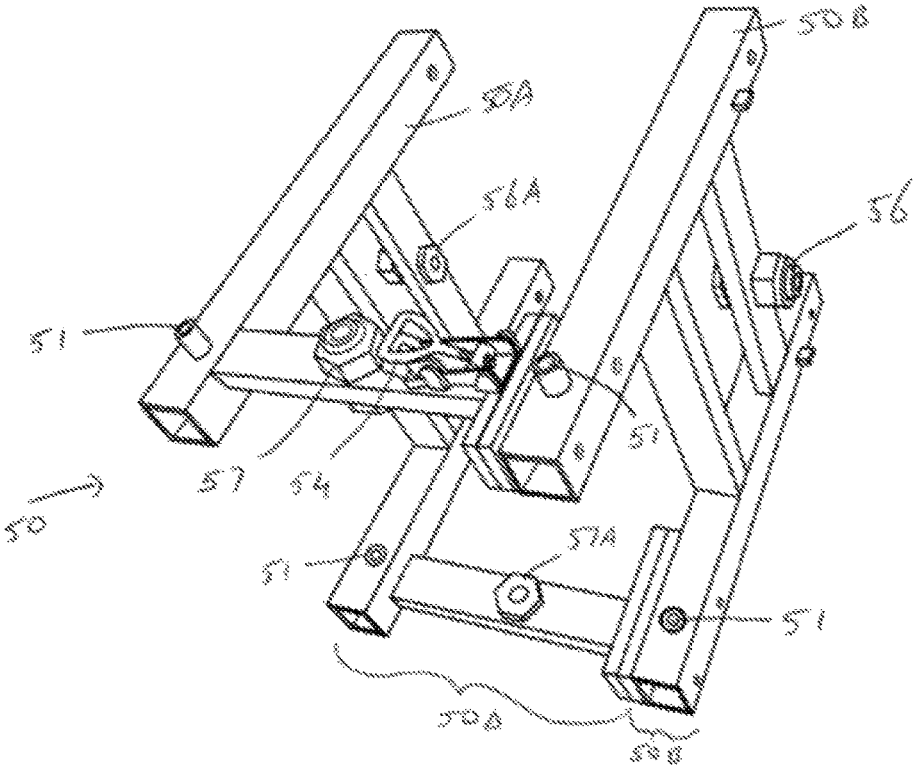
FIG. 15 shows a bottom perspective view of the sub structure.
Figure 16:
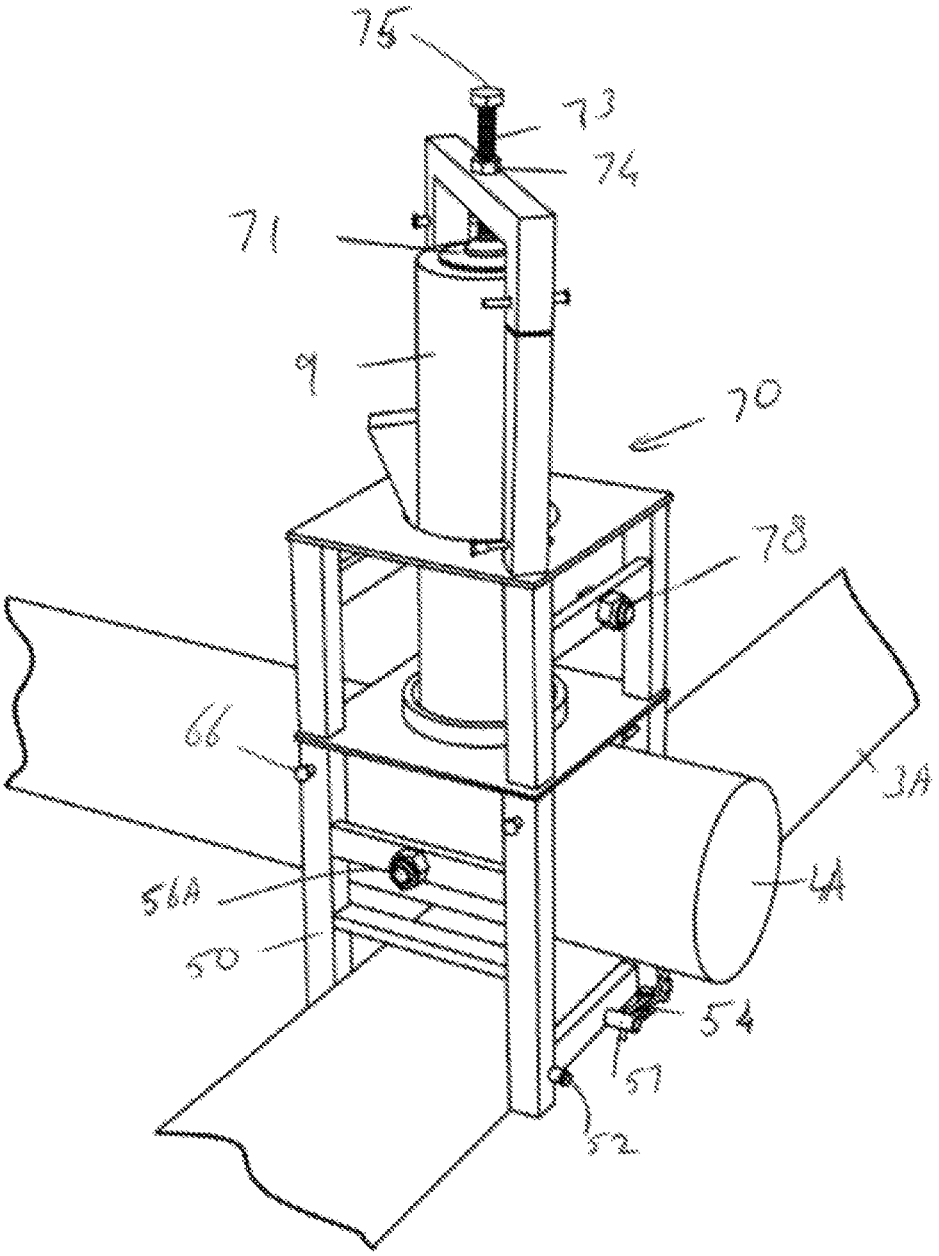
FIG. 16 shows a top perspective view of an assembly attachment and substructure at an intersection.

With reference to FIGS. 14, 15 and 16 reference will now be made to an assembly jig that may be used for assembling the foundation structure as has been described above. The assembly jig is preferably of a mobile nature and can be positioned at each intersecting region between a pole of an upper level and a pole of a lower level. The assembly jig allows for the poles to become secured to each other in situ rather than having to be prefabricated offsite and for subsequent assembly onsite. The prefabrication approach, whilst within the scope of the foundations structure herein described, may be quite time consuming if not difficult to achieve if the timber poles have, between been prefabricated with holes and being provided for assembly at a building site, for example dried or become more moist causing timber movement.

The assembly jig can be positioned at each intersection to thereat perform at least one of a number of preferred operations in order to allow for a dowel to become secured at the intersection of the components of the foundation structure.

The assembly jig preferably includes a substructure 50. The substructure 50 may be of a frame-like configuration as seen in FIGS. 14 and 15. The substructure is able to be secured to a lower level pole 3A at an intersecting region 5 between the lower level pole and an upper level pole 4A. The substructure 50 is preferably secured to a lower level pole by virtue of a threaded fastener such as a coach screw 52 passing through apertures 51 of the substructure and into the lower level pole 3A. In the preferred form the substructure 50 provides two regions at where the apertures 51 are provided one on each side of the lower level pole. This allows for the substructure 50 to become securely engaged to the lower level pole. The fasteners or screws 52 will hold the substructure in place in a secure and fixed manner relative to the lower level pole 3A.

The substructure itself may comprise of two separable component parts 50A and 50B. The two component parts allows for the substructure to be assembled about the upper level pole 4A at the intersection. Latches 54 may be used to conveniently and quickly allow for a releasable latching engagement between the components 50A and 50B of the substructure 50.

In the preferred form the substructure 50 presents at least one drill guide preferably for each of the holes 15 and 16 of the upper level pole 4A and lower level pole 3A respectively. An upper level pole drill guide 56 and a lower level pole drill guide 57 are shown in FIG. 15. In the preferred form such drill guides for each of the holes are provided to be presented on each side of a respective pole. As can hence be seen there is a drill guide 57 and a drill guide 57A for guiding a drill into the lower level pole 3A and there are two upper level pole drill guides 56 and 56A provided. This allows for an operator of a drill (such as a hand drill carrying a drill bit) to create the hole 16 and the hole 15 into the respective poles not just from one side of the pole but from both sides of the pole.

Where it is desirable for the pin to extend a substantial way through and if not out from and project out from each side of the pole having two drill guides one on each side of the pole allows for a shorter drill bit to be used but merely needs to be able to reach the centreline of the pole and/or the main hole 11/12 of a respective pole.

Preferably the upper level pole drill guides 56 and 56A and lower level pole drill guide 57 and 57A (not shown)

have a length and diameter tolerance to allow the drill bit to accurately locate itself collinear to the holes in the dowel and not to skew or whilst drilling.

In securing the substructure a level may be utilised for ensuring a desired rotational orientation of the substructure relative to the lower level pole 3A in an axis parallel to the pole and an axis perpendicular to the pole a desirable level is achieved. This is important for the purposes of ensuring that the drill guides are appropriately aligned to receive a drill to create the holes as well as for the purposes of establishing the primary holes 11 and 12 to receive the dowel.

The framework of the substructure is preferably adapted and configured to snugly fit about both the lower pole and the upper pole at the intersection. This helps to confine the lower and upper poles relative to each other during the process of drilling and fastening at the intersection 5.

The substructure 50 is provisioned with mounts and/or places for attachment of at least one attachment. The at least one attachment is preferably temporarily attached to the substructure. This allows for the attachment to be removed and where two attachments are provided it allows for the two attachments to be interchanged. Alternatively the attachment may instead be a permanent attachment to the substructure.

The second attachment that will now be described is a boring attachment. The boring attachment 60 as seen in FIG. 14 preferably comprises of a guide 61 that can guide a borer 62 for movement to create the holes to receive the dowel. In the preferred form the borer 62 is driven by a hydraulic motor 63 also supported for guided movement by the guide 61 of the boring attachment 60. The guide 61 preferably holds a guide traveller 64 that by way of a turn handle 65 is controlled for movement along the guide. An operator can turn the handle to drive the borer down and pull the borer up.

The use of a hydraulic motor is advantageous in environs where an electrical motor is not desirable. For example if it rains an electric motor may not be able to be used. In addition an electric motor is relatively heavy compared to a hydraulic motor. Using a hydraulic motor allows for the boring attachment to be of a size and weight to be able to be placed upon and taken off the substructure 50 by two if not one persons.

The connection between the substructure and the attachment may be established using pins 66 that temporarily secure the attachment to the substructure. In the preferred form the boring attachment when secured to the substructure presents the borer 62 in a substantially vertical orientation. It is preferably presented to first penetrate into the upper pole 4A and travel there through in a radial direction to that pole. It can then be driven down into the lower pole 3A to a sufficient depth so that the dowel is at least beyond the point at where the pin receiving hole is or will be established through the lower pole 3A.

In the preferred form the dowel is predrilled to receive the pins and therefore the depth of the hole into the lower pole made by the borer 62 is such as to substantially align the pin hole 18 of the dowel with the pin hole through the lower pole when the dowel sits on the bottom of the hole 12 in the lower pole. Once the holes 11 and 12 have been created by the borer the dowel can be inserted into the holes.

At this stage or prior the holes to receive the pins 13 and 14 can be drilled by for an example an electric hand drill carrying a drill bit that is guided by the drill guides to reach the dowel holes. The dowel holes may already have their matching pin holes predrilled or alternatively the drill bit may simultaneously create such holes through the dowel for the pin to then be received therein. Prior to the dowel being inserted into the dowel holes of the upper and lower poles the boring attachment can be removed so as to allow for free access to the holes to drop the dowel into.

It is desirable where a non-jack stud provisioned intersection is created and/or where a jack stud is provided at the intersection for the upper and lower poles to be compressed together prior to the pins being inserted to fasten the dowel to the foundation structure at the intersection.

To facilitate this compression an assembly attachment 70 may be secured to the substructure 50. In FIG. 16 the assembly attachment 70 is shown cooperating with a jack stud 9. The assembly attachment functions to compress the first layer pole and the second layer pole before the dowel is secured. A press 71 may be provided to act on the jack stud 9 and compress the jack stud to thereby compress the upper and lower poles 4A and 3A. The press may include a threaded rod 73 received by a threaded aperture 74 of the assembly attachment. A spanner or torque wrench for example can operate on the head 75 of the threaded rod 73 and rotate it to then cause the press 71 to press onto the jack stud 9. Preferably the compression allows for a snug abutment between poles (and the jack stud when provided).

In embodiments where no compression is used in the assembly, preferably there is no more than 5 mm between abutting first and second layer poles and the second layer poles, and no more than 5 mm between the poles and the jack studs.

Where no jack stud is provided at the intersection it will be appreciated that the press can act directly onto the upper pole 4A prior to one or both of the pins 13 and 14 being driven into and preferably through the dowel to thereby secure the dowel as part of the foundation structure. The assembly attachment may be reconfigured to drop the press down where there is no jack stud provided.

Where a jack stud is provided at the intersection the assembly attachment preferably includes at least one drill guide 78 to receive a drill bit for guided movement into the jack stud to create the pole 24 to receive the pin 23. In the preferred form there are two such drill guides, one on each side of the pole, so that an operator can thread a through hole without requiring a long drill bit to extend from one side of the pole to the other. When under compression by the press one or both of the pins 14B and 23 can be inserted respectively into the lower pole 3A and the jack stud 9 and thereby secure the dowel 10B as part of the foundation structure and hold the jack stud 9 the upper pole 4A and lower pole 3A together in compression.

In a similar manner to how the boring attachment can be secured to the substructure the assembly attachment can likewise be secured using the pins 66 or other fasteners to become secured to the substructure in a manner that holds the drill guide 78 and the press in the appropriate condition to achieve the herein described results.

Preferably, the foundation is capable of being disassembled or modified in a non-destructive manner. The pins are able to knocked out and the jack stud if present lifted off, the upper layer removed, dowel removed and subsequently the bottom layer removed. All parts may then be reused and reassembled.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

The invention claimed is:

1. A foundation for supporting a structure above, the foundation comprising a. a first layer of at least two timber poles, each pole of the first layer parallel and spaced apart from each other, b. a second layer of at least two timber poles, each pole of the second layer parallel and spaced apart from each other, each laying on timber poles of the first layer at an angle to span across at least two poles of the first layer and each fastened to each said two poles of said first layer at at least one intersection of said poles wherein at at least one intersection a first layer pole includes a hole that is selected from one of a blind hole and a through hole and a juxtaposed second layer pole includes a through hole in axial alignment with said hole of the first layer pole, and a penetrated fastener is located in the hole of the first layer pole and the hole of the second layer pole, where the penetrated fastener is pinned to the first layer pole by a first pin passing laterally through said penetrated fastener and at least partially through said first layer pole, and a second pin passes laterally through said penetrated fastener and one or more selected from the second layer pole and a jack stud located above and bearing down on the second layer pole, wherein the fastener is in tension to compress, or keep compressed, the first layer pole to the respective second layer pole.

2. A foundation as claimed in claim 1 wherein the penetrated fastener is not exposed at where the poles at the intersection touch.

3. A foundation as claimed in claim 1 wherein the penetrated fastener comprises a straight rigid tube or rod.

4. A foundation as claimed in claim 1 wherein the penetrated fastener has a head at one end of the penetrated fastener to locate against the outer surface of the first layer pole and has a shank passing through the first layer pole and second layer pole, the penetrated fastener also having a threaded end opposite it's one end where the head is provided configured to receive a nut to be located on the outer surface of the second layer pole.

5. A foundation as claimed in claim 1 wherein the penetrated fastener has a head at one end of the penetrated fastener to locate against the outer surface of the first layer pole and has a shank passing through the first layer pole and second layer pole and the vertical jack stud, the penetrated fastener having a threaded end opposite it's one end where the head is provided, configured to receive a nut to be located on an outer surface of the jack stud.

6. A foundation as claimed in claim 1 wherein, the vertical jack stud is located above, and supported by, the second layer pole at a said intersection.

7. A foundation as claimed in claim 6 wherein the penetrated fastener penetrates the jack stud.

8. A foundation as claimed in claim 6 wherein the jack stud has a blind hole extending into the jack stud from its bottom face up and into which a said penetrated fastener extends.

9. A foundation as claimed in claim 6 wherein the jack stud is able to support one of timber joists, metal joists, flooring, bearers and framing of or for a structure to be supported above.

10. A foundation as claimed in claim 1 wherein at each intersection where a said penetrated fastener is located, the penetrated fastener is pinned to the second layer pole by a second pin passing laterally through said penetrated fastener and at least partially through said second layer pole.

11. A foundation as claimed in claim 5 wherein at each intersection where a said penetrated fastener is located, the penetrated fastener is pinned to the jack stud by a jack pin passing laterally through said penetrated fastener and at least partially through said jack stud.

12. A foundation as claimed in claim 1 wherein there is no gap between abutting first layer pole and second layer pole at an intersection.

13. A foundation as claimed in claim 1 wherein the foundation is located on ground that directly supports the foundation.

14. A foundation as claimed in claim 1 wherein the angle between the first layer poles and the second layer poles is 90 degrees.

15. A foundation as claimed in claim 14 wherein the second layer may include at least one additional pole that is not parallel to the at least two poles of the second layer.

16. A foundation as claimed in claim 1 wherein the spaced parallel distance between poles of the same layer is between 1 and 3 meters.

17. A foundation as claimed in claim 1 wherein the poles of each layer of poles are horizontal.

18. A foundation as claimed in claim 1 wherein said layers are parallel to each other.

19. A method of constructing a foundation comprising the following steps:

a. preparing a ground site by removing earth to form a pit with a substantially planar base, b. placing a plurality of poles on the planar base to define a first layer of poles in the pit, and securing a plurality of poles to poles of the first layer to define a second layer of poles on top of the first layer of poles wherein the second layer of poles overlap the first layer of poles at intersections, and at at least one intersection a first layer pole includes a hole that is selected from one of a blind hole and a through hole and a juxtaposed second layer pole includes a through hole in axial alignment with said hole of the first layer pole, and a penetrated fastener is located in the hole of the first layer pole and the hole of the second layer pole, c. passing a first pin laterally through said fastener and at least partially through said first layer pole, d. passing a second pin laterally through said fastener.

20. A foundation construction for a building located above sloping ground, comprising a. at a first terrace established at a first level of said sloping ground, a first foundation as claimed in claim 1 b. at a second terrace established at a second level of said sloping ground that is above the first level, a second foundation as claimed in claim 1 c. a plurality of upwardly from said first level extending poles (herein after "retaining poles") each secured to one of (a) a pole of said first layer of said first foundation and (b) a pole of said second layer of said first foundation, at a lower end of said retaining poles and to one of (a) a pole of said first layer of said second foundation and (b) a pole of said second layer of said second foundation, at an upper end of said retaining poles.

* * * * *